US012251591B1

(12) United States Patent
Roh

(10) Patent No.: US 12,251,591 B1
(45) Date of Patent: Mar. 18, 2025

(54) EXERCISE EQUIPMENT

(71) Applicant: Yong Hyun Roh, Yangju-si (KR)

(72) Inventor: Yong Hyun Roh, Yangju-si (KR)

(73) Assignee: Yong Hyun Roh, Yangju-si (KR)

( * ) Notice: Subject to any disclaimer, the term of this patent is extended or adjusted under 35 U.S.C. 154(b) by 0 days.

(21) Appl. No.: 18/726,935

(22) PCT Filed: Nov. 4, 2022

(86) PCT No.: PCT/KR2022/017184
§ 371 (c)(1),
(2) Date: Jul. 5, 2024

(87) PCT Pub. No.: WO2023/132451
PCT Pub. Date: Jul. 12, 2023

(30) Foreign Application Priority Data

Jan. 6, 2022 (KR) ..... 10-2022-0002155

(51) Int. Cl.
*A63B 21/00* (2006.01)
*A63B 21/02* (2006.01)
(Continued)

(52) U.S. Cl.
CPC ..... *A63B 21/0004* (2013.01); *A63B 21/026* (2013.01); *A63B 21/0442* (2013.01); *A63B 21/0552* (2013.01)

(58) Field of Classification Search
CPC ..... A63B 21/0004; A63B 21/026; A63B 21/0442; A63B 21/0552
See application file for complete search history.

(56) References Cited

U.S. PATENT DOCUMENTS 1,576,474 A * 3/1926 Walker ..... A63B 21/045 482/126
2,396,106 A * 3/1946 Kussnir ..... A63B 21/027 482/109
(Continued)

FOREIGN PATENT DOCUMENTS

CN 105680526 A 6/2016
CN 209984847 U 1/2020
(Continued)

OTHER PUBLICATIONS

Opinion of International Searching Authority issued on Mar. 17, 2023, in counterpart international Patent Application No. PCT/KR2022/017184.
(Continued)

*Primary Examiner* — Joshua Lee
(74) *Attorney, Agent, or Firm* — NSIP Law

(57) ABSTRACT

The present invention relates to exercise equipment and, more specifically, to exercise equipment which can be utilized in a space that is not large while preventing noise between floors indoors and forms elastic waves in the waving direction of a user so that an exercise effect which is the same as that of battle ropes can be provided to the body of the user, the exercise equipment comprising: an elastic plate made from an elastic material of a predetermined length; and a weighted member provided at one end of the elastic plate, wherein waves are elastically formed in the elastic plate as the user holding a handle provided at the other end of the elastic plate waves same.

3 Claims, 10 Drawing Sheets

(51) Int. Cl.
*A63B 21/04* (2006.01)
*A63B 21/055* (2006.01)

(56) References Cited

U.S. PATENT DOCUMENTS 3,559,988 A * 2/1971 Greenless ..... A63B 21/045 482/44
4,428,577 A * 1/1984 Weingardt ..... A63B 21/00043 482/126
8,827,231 B1 * 9/2014 Blair ..... E04H 12/22 52/698
9,901,766 B2 * 2/2018 Ross ..... A63B 22/0005
10,220,242 B2 * 3/2019 Matos ..... A63B 21/1654
10,632,336 B2 * 4/2020 Townsend ..... A63B 21/151
10,981,029 B2 * 4/2021 Parise ..... A63B 21/028
11,524,200 B2 * 12/2022 Pettersson ..... A63B 23/03525
2013/0123082 A1 * 5/2013 Bashraheel ..... A63B 22/16 482/141
2014/0141943 A1 * 5/2014 DiPace ..... A63B 21/0557 482/93
2014/0141946 A1 * 5/2014 Huber ..... A63B 23/1209 482/110
2015/0265869 A1 * 9/2015 Hemstreet ..... A63B 21/4043 482/110
2015/0283421 A1 * 10/2015 Gaylord ..... A63B 21/28 482/110
2017/0368405 A1 * 12/2017 Matos ..... A63B 21/4035
2019/0388722 A1 * 12/2019 Townsend ..... A63B 21/151
2020/0391071 A1 12/2020 Pen et al.

FOREIGN PATENT DOCUMENTS

JP 3075856 U 3/2001
JP 3139081 U 1/2008

OTHER PUBLICATIONS

International search report issued on Mar. 17, 2023, in counterpart international Patent Application No. PCT/KR2022/017184.
Korean Office Action issued on Nov. 26, 2023, in counterpart Korean Patent Application No. 10-2022-0002155.
Korean Notice of Allowance issued on Feb. 14, 2024, in counterpart Korean Patent Application No. 10-2022-0002155.

* cited by examiner

EXERCISE EQUIPMENT

CROSS REFERENCE TO RELATED APPLICATIONS

This application is a U.S. National Stage Application of International Application No. PCT/KR2022/017184 filed Nov. 4, 2022, which claims priority to KR application 10-2022-0002155 filed Jan. 6, 2022, in the Korean Intellectual Property Office, the entire disclosure of which is incorporated herein by reference for all purposes.

TECHNICAL FIELD

The present disclosure relates to exercise equipment, and more particularly, to exercise equipment capable of obtaining the same exercise effect as that of a battle rope by waving the exercise equipment formed of an elastic plate up and down.

BACKGROUND ART

Recently, as interest in health has increased, the number of people exercising to manage their health is gradually increasing.

In particular, as the number of people who engage in exercise such as yoga, pilates, and fitness to not only stay healthy but also to achieve the desired body shape is increasing and the number of exercise-related content on video platforms such as YouTube increases significantly, it is becoming a popular trend for people to perform home training by preparing simple exercise equipment at home and exercising while watching exercise-related content, rather than going to an exercise facility and paying expensive fees.

However, there is a problem with home training at home that it is difficult to perform exercise with equipment, which is an exercise that may put a lot of load on the muscles while burning fat throughout the body, and exercise in the form of simply lifting and placing tools in various motions a large number of times is repeated.

To solve this problem, Korean Registered Utility Model Publication No. 20-0484830 (hereinafter referred to as the 'cited invention') discloses a full-body exercise rope that may be used at home while increasing durability of the full-body exercise rope.

The battle rope exercise using the full-body exercise rope is an exercise that holds two ropes, which are fixed at a certain point and have a predetermined length, with both hands with the knees slightly bent and both arms extended forward, and then waves both arms alternately or simultaneously in the up and down directions, and may not only increase muscle resistance, but also strengthen muscle strength by moving the entire body, including an abdomen, arms, and shoulders, improves a cardiovascular function, help with diet, and have various exercise effects, including building muscle and strengthening exercise ability.

However, this type of full-body exercise rope has the disadvantage of requiring a wide space to exercise since momentum varies depending on a length, and has a risk of noise between floors since the rope continuously collides with a floor indoors. Therefore, there is an emerging need for the development of exercise equipment that may perform full-body exercise and various exercises using simple tools even in a small space.

DETAILED DESCRIPTION OF INVENTION

Technical Problems

According to one embodiment of the present disclosure, the present disclosure provides exercise equipment that is made of an elastic material with a predetermined length, has the same exercise effect as that of a battle rope by elastically forming waves as a user waves a handle up and down while holding the handle, and can be utilized in a small space while preventing noise between floors.

According to one embodiment of the present disclosure, the present disclosure provides a variety of exercise equipment that can perform exercise to train various body parts in a limited small space such as indoors.

Technical Solution

To achieve the above object, according to the present disclosure, exercise equipment includes: an elastic plate made of an elastic material having a predetermined length; and a weighted member provided at one end of the elastic plate, in which a user may hold and wave a handle provided at the other end of the elastic plate, the elastic plate may elastically form a wave.

The elastic plate may be formed of a leaf spring formed in a strip shape.

The exercise equipment may further include a support including a support part supported on a ground and a connection part formed upward from the support part, in which the handle may have one end connected to the elastic plate and the other end connected to the connection part.

The handle may be detachably coupled to the elastic plate and the support, respectively.

The elastic plate may be partially inserted into one end of the handle, and the handle may include a fixture that fixes the inserted elastic plate.

Effect of Invention

According to the present disclosure, the exercise equipment can be utilized in a space that is not large while preventing noise between floors indoors and form elastic waves in a waving direction of a user to provide the same exercise effect as that of battle ropes to a body of the user.

In addition, the handle coupled to the other end of the elastic plate is detachably coupled to the support and the elastic plate, so that when only the handle and the support are coupled, a push-up module is formed and thus can be used as a variety of exercise equipment.

BEST MODE FOR CARRYING OUT THE INVENTION

The present disclosure provides exercise equipment including an elastic plate that is made of an elastic material with a predetermined length so that as the user waves the elastic plate up and down, waves are elastically formed to have the same exercise effect as that of a battle rope; and a weighted member that is provided at one end of the elastic plate, in which as a user holds and waves a handle provided at the other end of the elastic plate, the elastic plate elastically forms waves.

The scope of the present disclosure is not limited to embodiments described below, and various modifications may be made by those skilled in the art without departing from the technical gist of the present disclosure.

Hereinafter, the exercise equipment of the present disclosure will be described in detail with reference to the attached FIGS. 2 to 10.

Figure 1:
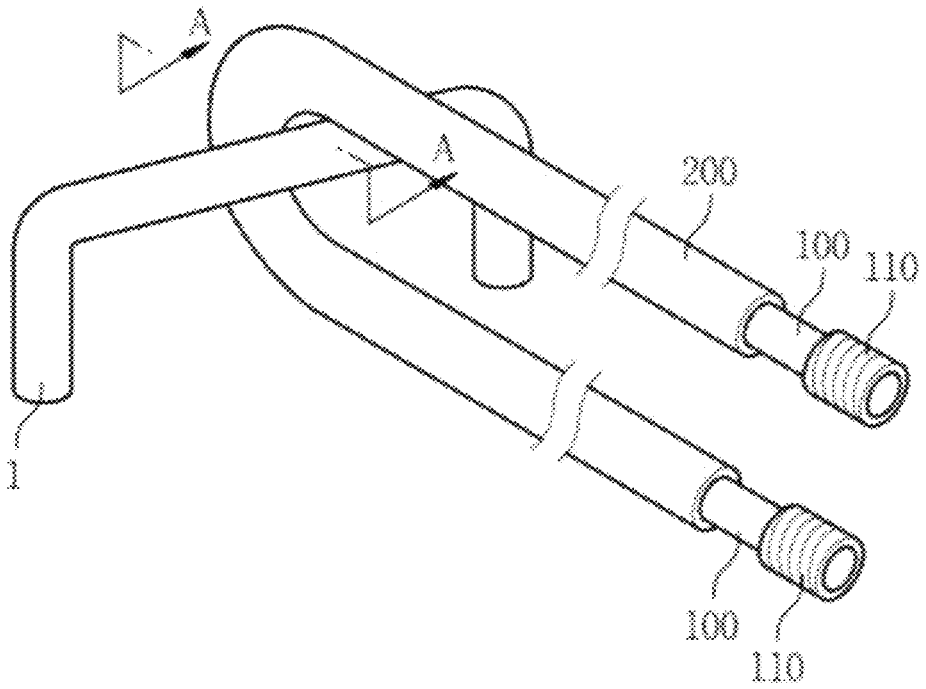
FIG. 1 is a diagram illustrating the related art.
Figure 2:
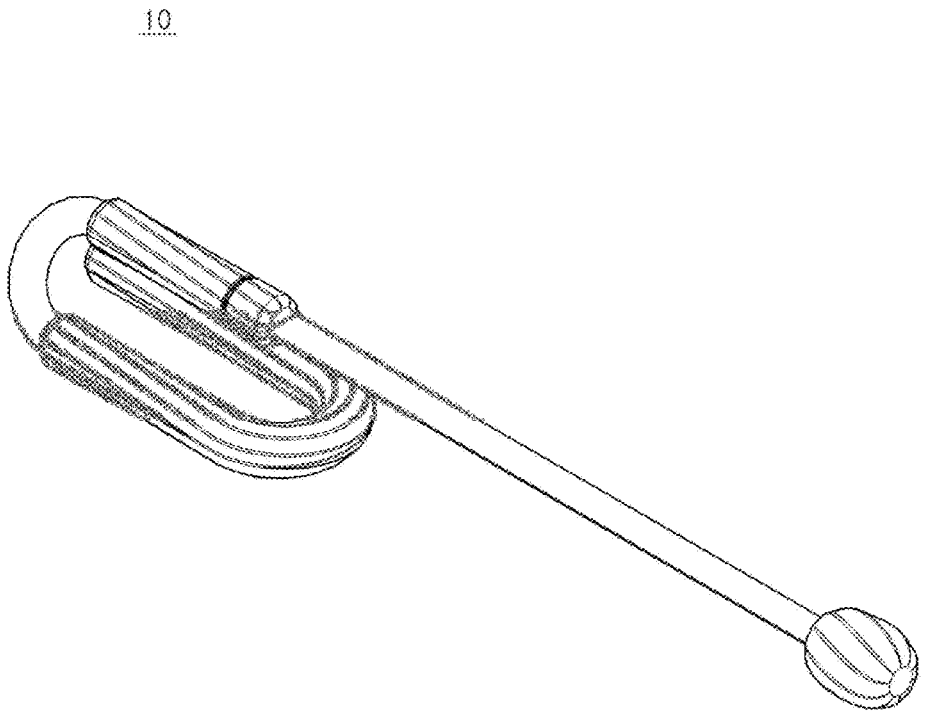
FIG. 2 is a perspective view of exercise equipment according to an embodiment of the present disclosure.
Figure 3:
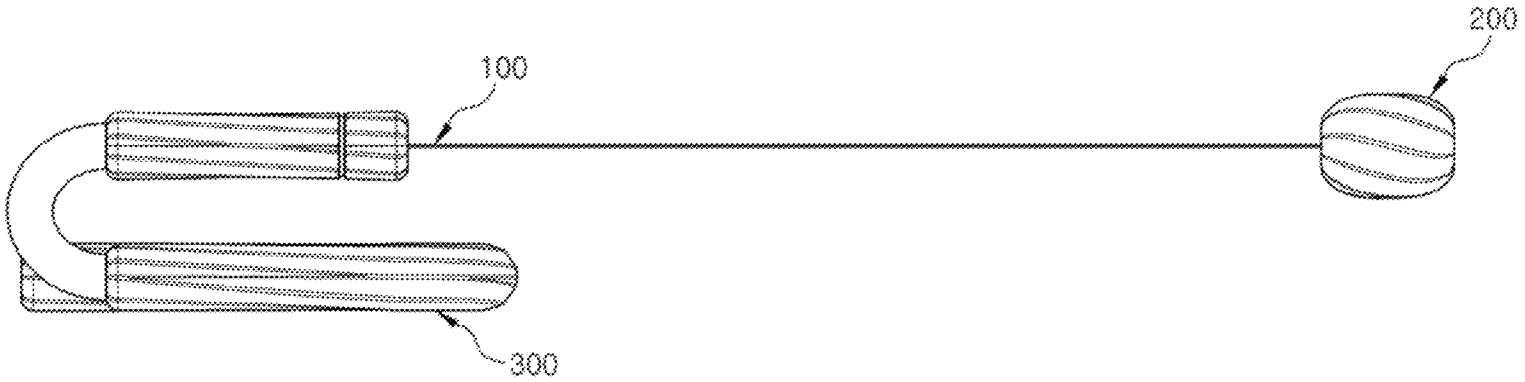
FIG. 3 is a front view of the exercise equipment according to an embodiment of the present disclosure.
Figure 4:
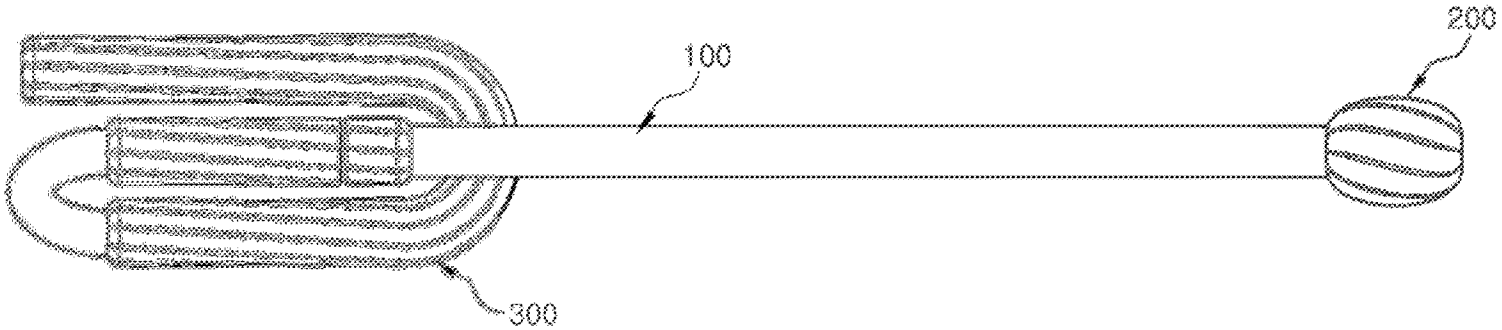
FIG. 4 is a plan view of the exercise equipment according to an embodiment of the present disclosure.
Figure 5:
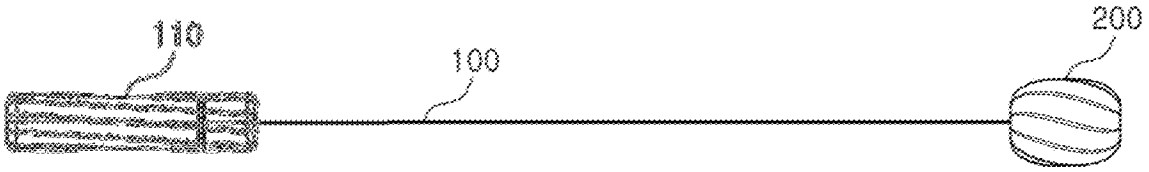
FIGS. 5 and 6 are exemplary diagrams of an elastic plate according to one embodiment of the present disclosure.
Figure 6:
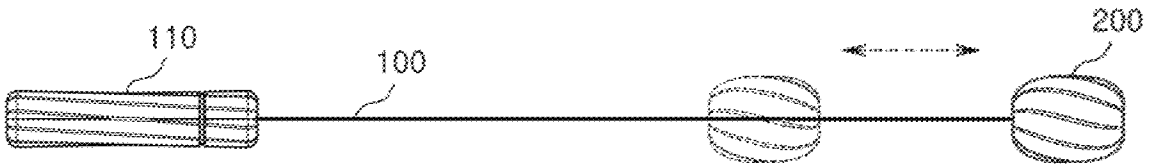
Figure 7:
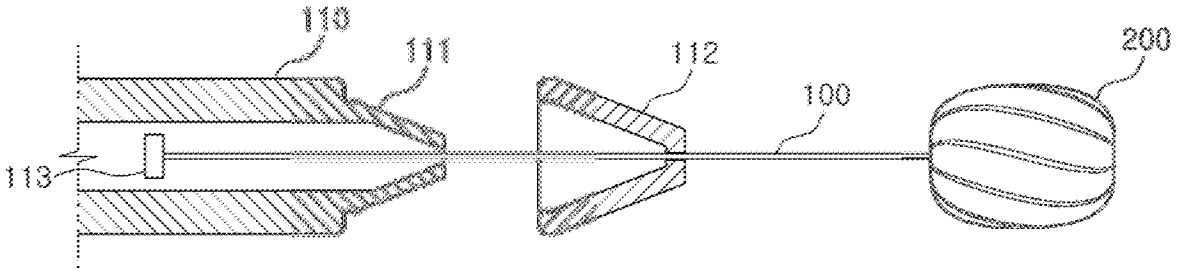
FIG. 7 is an exemplary view of a fixing structure of the elastic plate according to an embodiment of the present disclosure.

As illustrated in FIGS. 5 to 7, exercise equipment 10 of the present disclosure may include an elastic plate 100 made of an elastic material with a predetermined length, a weighted member 200 provided at one end of the elastic plate 100, and a handle 110 provided at the other end of the elastic plate 100.

The shape of the elastic plate 100 is not limited, but as illustrated in FIGS. 2 to 8, it is preferably formed in the shape of a strip-shaped leaf spring as a structure suitable for elastically forming waves.

As the user holds the handle 110 provided at the other end of the elastic plate 100 and waves the handle 110 in the up and down directions, waves are formed elastically toward one end of the elastic plate 100, the elastic plate 100 elastically forms waves toward one end, and the elastically formed waves may gradually become larger depending on the waving width of the user.

In addition, the size of the wave elastically formed toward one end may increase due to the weighted member 200 provided at one end of the elastic plate 100, and the size of the wave may be proportional to the weight of the weighted member 200.

The weighted member 200 may be provided at one end of the elastic plate 100 as illustrated in FIGS. 5 and 6, and the weighted member 200 with different weights may be replaced and used depending on the user's condition or the user's exercise ability to be detachably coupled from one end of the elastic plate 100.

For example, when an elderly person with weak muscles uses the elastic plate 100, the weighted member 200 may be separated from the elastic plate 100 so that only the elastic plate 100 may be used without the weighted member 200. When an expert uses the elastic plate 100, the weighted member 200 is separated from the elastic plate 100 so that exercise may be performed using a weighted member 200 heavier than the standard weighted member 200. Thereafter, the heavier weighted member 200 may be coupled to one end of the elastic plate 100.

In addition, the weighted member 200 may be moved in the longitudinal direction of the elastic plate 100 to shift the center of gravity of the elastic plate 100. Through this, even if the same weighted member 200 is used, the user may stimulate muscles in the desired area by changing the center of gravity of the elastic plate 100.

The weighted member 200 is formed in a round shape in FIGS. 2 to 8, but is not limited to its shape or material, and may be used in various shapes depending on the length, elastic force, and area of the elastic plate 100.

In addition, the weighted member 200 may be formed with a certain weight that may be converted into weights and measures such as KG units or pounds. As described above, the weighted members 200 with different weights may be replaced and used depending on the user's condition or exercise ability.

Based on the above-described information, the elastic plate 100 made of an elastic material with a predetermined length has a weighted member 200 provided at one end thereof, and as the user holds and waves the other end of the elastic plate 100, the elastic plate 100 may provide the same exercise effect as that of the battle rope to the user's body by forming the elastic waves in the waving direction of the user.

As illustrated in FIGS. 5 to 8, the elastic plate 100 may have the handle 110 provided at the other end so that the user may easily hold the elastic plate 100, and the handle 110 is formed in a rod shape with a predetermined length, and one end may be detachably coupled to the other end of the elastic plate 100. In this case, the shape of the handle 110 is described as a rod, but the shape is not limited.

In this case, there is no limitation on the way the handle 110 and the elastic plate 100 are coupled. For example, a male thread is formed on one end of the handle 110, and a female thread is formed on the elastic plate 100, and thus, one end of the handle 110 may be inserted and fastened to the other end of the elastic plate 100.

Figure 8:
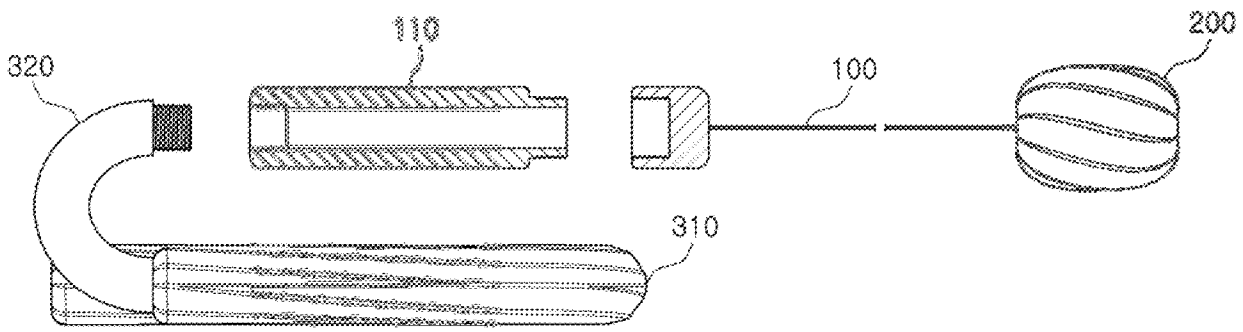
FIG. 8 is an exemplary diagram of the exercise equipment according to an embodiment of the present disclosure.

As illustrated in FIGS. 7 and 8, the handle 110 has an empty space formed on the inside, and the length of the elastic plate 100 may be adjusted as the elastic plate 100 is partially inserted into the inside of the handle 110.

In this case, the coupling part 111 may be formed at one end of the handle 110 in a shape where the area becomes narrower toward one direction.

The coupling part 111 formed on the handle 110 is provided with an inlet through which the elastic plate 100 may be inserted into the empty space formed inside the handle 110, and when the elastic plate 100 is inserted into the inlet, the inlet may pressurize the elastic plate 100.

In addition, the handle 110 may include a fixture 112 for fixing the position of the elastic plate 100 inserted into the empty space on the inside through the inlet.

The inside of the fixture 112 is formed in a shape corresponding to the outside of the coupling part 111 of the handle 110, and the elastic plate 100 partially inserted into the inside of the handle 110 through the inlet formed in the coupling part 111 is engaged with the coupling part 111 to be fixed, so the inlet of the coupling part 111 may be pressed, thereby fixing the elastic plate 100 to the handle 110.

The shapes of the coupling part 111 and the fixture 112 may be formed in various shapes, and there is no limitation on the coupling structure in which the elastic plate 100 is fixed by fastening the coupling part 111 and the fixture 112.

In addition, the elastic plate 100 may be inserted into the direction of the other end of the separated handle 110, and the other end of the elastic plate 100 is provided with a stopper 113 to prevent the elastic plate 100 from being discharged in excess of a predetermined length as illustrated in FIG. 7.

In addition, the handle 110 may be engraved with a specific pattern or have a protrusion formed therein to prevent the user's hand from slipping due to friction at a point held by the user.

In this case, there are no limitations on the shape and pattern to prevent the friction formed on the handle 110.

As illustrated in FIGS. 2 to 4 and 8 to 9, the support 300 may include a support part 310 supported by the ground, and a connection part 320 formed upward from the support part 310. The support part 310 is illustrated in a 'U' shape in FIGS. 2 and 9, but it is preferably formed in a shape to be stably supported on the ground, and the shape is not limited.

The connection part 320 may extend upward from one end of the support part 310 and is detachably coupled to the handle 110 in a lying state that is spaced apart from the support 300, and it is preferable that the coupling structure of the connection part 320 and the handle 110 be coupled in a screw coupling structure that may be easily coupled and may withstand a certain load.

Figure 9:
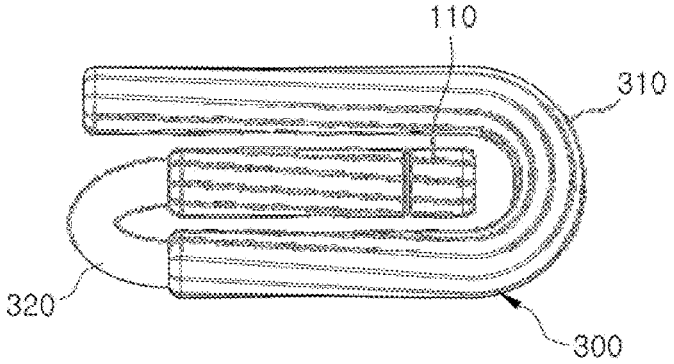
FIG. 9 is an exemplary diagram of a push-up module, according to an embodiment of the present disclosure.
Figure 10:
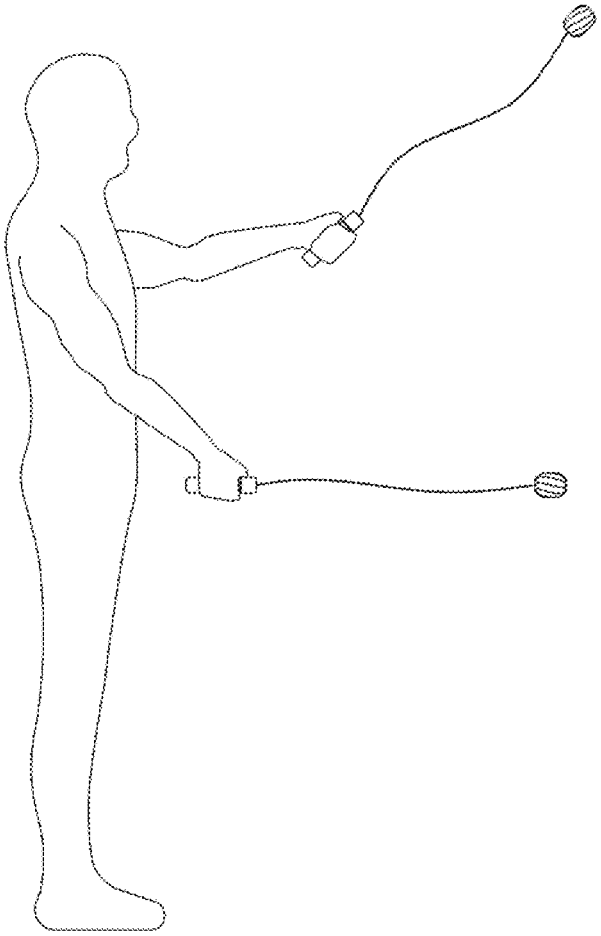
FIG. 10 is an exemplary diagram of the use of the exercise equipment according to an embodiment of the present disclosure.

The handle 110 coupled to the support 300 can be used as a push-up module as illustrated in FIG. 9, and the user may hold the handle 110 while supporting at least one push-up module on the ground to perform a push-up motion.

Based on the above-described contents, the exercise equipment 10 of the present disclosure may have the handle 110 coupled to the other end of the elastic plate 100 and detachably coupled to the support 300 and the elastic plate 100, when only the handle 110 and the elastic plate 100 are coupled, may be used in a small space while preventing noise between floors, may allow the user to obtain the same exercise effect as that of the battle rope on the user's body by forming the elastic waves in the waving direction of the user, and when only the handle 110 and the support 300 are coupled, may be used as the push-up module to enable the push-up in various postures.

The exercise equipment 10 of the present disclosure can be easily utilized by users to enable various types of exercise.

DESCRIPTION OF REFERENCE NUMERALS

10: Exercise equipment 100: Elastic plate
110: Handle 111: Coupling part
112: Fixture 113: Stopper
200: Weighted member 300: Support
310: Support part 320: Connection part

What is claimed is:

1. Exercise equipment, comprising:

a support comprised a holder supported on a ground and a connector formed upward from the holder with an end thereof disposed horizontally with a surface of the ground;

an assembly comprising a handle having a first end connected to the connector, an elastic plate having a first end connected to a second end the handle, and a weighted member disposed at a second end of the elastic plate, wherein a user is enabled to perform a battle rope exercise using the assembly alone, to perform a push-up exercise with the assembly placed on the ground while connected to the support, or to perform a battle rope exercise by holding the handle.

2. The exercise equipment of claim 1, wherein the elastic plate is formed of a leaf spring shaped as a strip.

3. The exercise equipment of claim 1, wherein the elastic plate is configured to be partially inserted into the second end of the handle, and wherein the handle comprises a fixture (112) that fixes the inserted elastic plate (100).

* * * * *